United States Patent [19]

Ragard et al.

[11] 3,938,364

[45] Feb. 17, 1976

[54] WRAPPING POST SWAGING APPARATUS

[75] Inventors: Phillip Anthony Ragard, Binghamton; Keith Alan Young, Maine, both of N.Y.

[73] Assignee: Universal Instruments Corporation, Binghamton, N.Y.

[22] Filed: Aug. 13, 1974

[21] Appl. No.: 497,083

[52] U.S. Cl. ..... 72/403; 72/402

[51] Int. Cl.[2] ..... B21J 17/16

[58] Field of Search ..... 72/402, 403, 452; 29/203 D, 630 D; 10/43, 45, 53

[56] References Cited

UNITED STATES PATENTS

| | | | |
|---|---|---|---|
| 2,622,652 | 12/1952 | Conroy et al. | 72/402 |
| 2,790,188 | 4/1957 | Fray | 72/402 |
| 3,416,352 | 12/1968 | Ribback | 72/403 |
| 3,538,735 | 11/1970 | Zimmerman | 72/402 |
| 3,695,310 | 10/1972 | Donadio | 72/402 |
| 3,713,322 | 1/1973 | Fischer | 72/403 |

FOREIGN PATENTS OR APPLICATIONS

| | | | |
|---|---|---|---|
| 480,411 | 2/1938 | United Kingdom | 72/402 |

*Primary Examiner*—Lowell A. Larson

*Attorney, Agent, or Firm*—Fidelman, Wolffe & Leitner

[57] ABSTRACT

A device for preparing lengths of material used for circuit board wrapping posts characterized by two pairs of swaging members which act to narrow adjacent cross-sections of the length of material down to a truncated pyramid form suitable for severing and for wire wrapping requirements.

6 Claims, 14 Drawing Figures

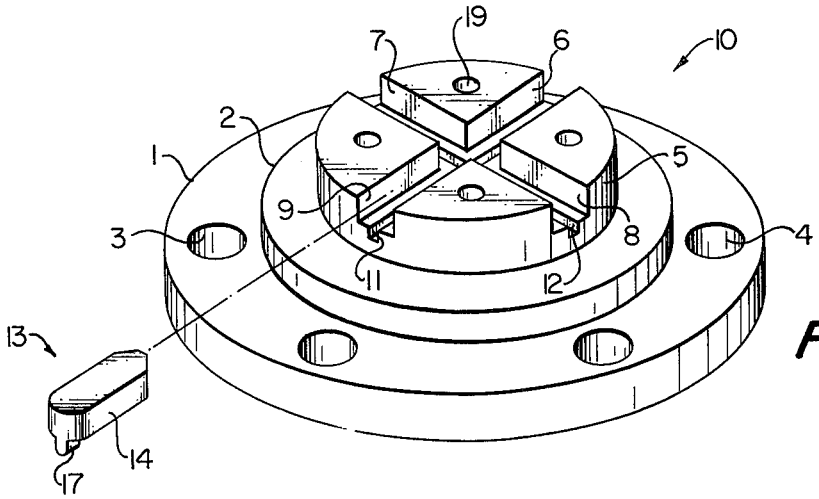
FIG. 1
FIG. 2
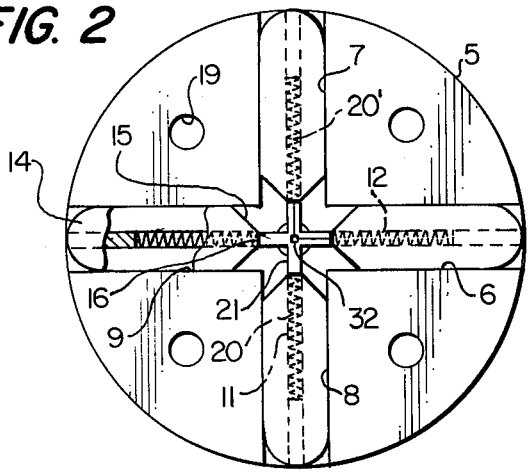
FIG. 3
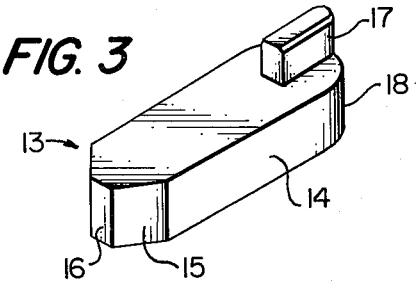
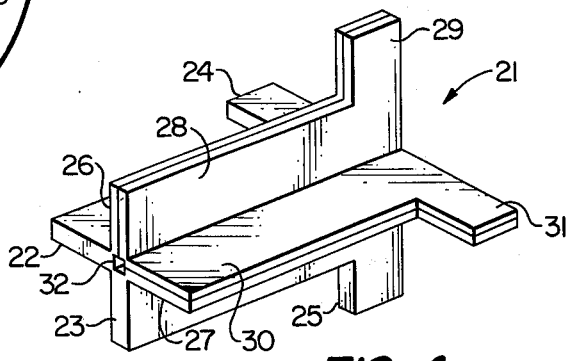
FIG. 4
FIG. 5
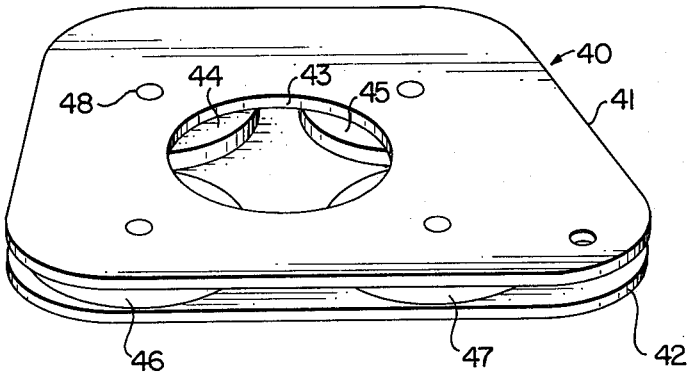

FIG. 6
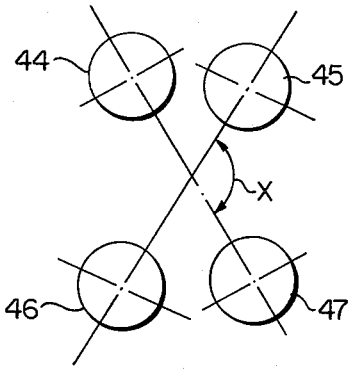
FIG. 7
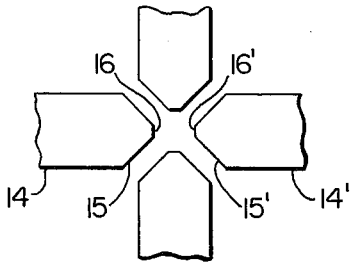
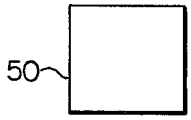
FIG. 8A
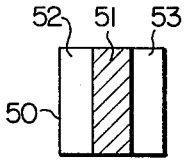
FIG. 8B
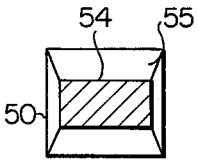
FIG. 8C
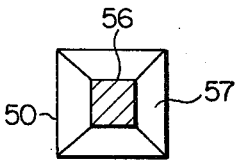
FIG. 8D
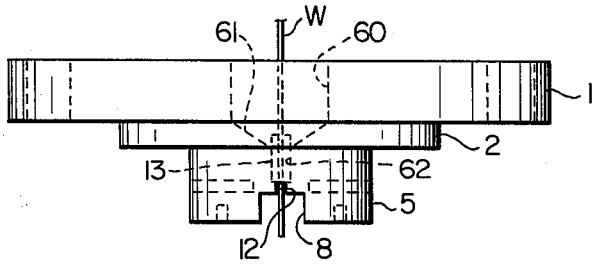
FIG. 9
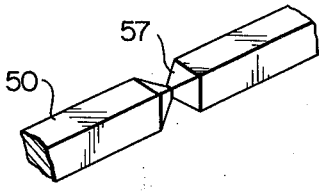
FIG. 10
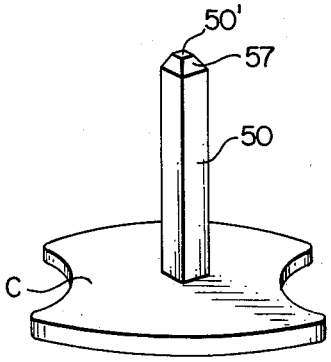
FIG. 11

WRAPPING POST SWAGING APPARATUS

This invention relates to a new and novel apparatus for preparing lengths of material used for wire wrapping posts.

In the electronic and electrical component assembly field, a great deal of point-to-point wire wrapping is encountered. This involves the employment of wire wrap posts secured in a common base, i.e. a circuit board. The posts are usually made of a brass or copper alloy and project perpendicularly from the board. A bit carrying a length of conductive wire with a stripped end descends onto the posts, wraps one stripped end on that post, then moves on to another post and wraps it with the other stripped end.

To accomplish tight and adequate wire wraps, the top of the post, usually square in cross-section, should be of a truncated pyramid. Since the post material usually comes in long lengths, it has been difficult to cut the material and then shape one end of each post to the desired configuration. Some posts have been manufactured individually resulting in a tremendous price per unit.

This invention is concerned with the quick, accurate, efficient and inexpensive manufacture of such posts. To accomplish this goal, a rotary swaging apparatus is employed. The wire is first fed through a stabilizing portion of the apparatus and then sequentially stopped at predetermined intervals, these intervals corresponding to the desired length of each batch of posts. It is understood that the length of each batch may vary. At each stop, a rotary member is rotated through approximately 90°. Within the rotary member are two pairs of juxtapositioned rollers, the axis through each pair being less than 90°. The rollers force four biased swaging members inwardly to pinch and form the wire. Three engagements of the wire occur, the first pair of rollers, the second pair of rollers then the first pair again as the rotary member is counter-rotated to its initial position.

This completes shaping a portion of the length of wire which is then advanced and the same operation takes place again.

Accordingly, it is an object of this invention to provide an apparatus for preparing lengths of material used in wire wrap posts.

It is a further object of this invention to provide an apparatus for forming a double truncated pyramid in lengths of wire used for wire wrap posts.

A further object of this invention is to provide a length of material which may be easily severed by hand into individual wire wrap posts.

These and other objects will become readily apparent when reference is had to the accompanying specification and drawings in which:

FIG. 1 is a perspective view of the stationary support member showing one of the swaging members in exploded view;

FIG. 2 is a plan view of the top portion of the member of FIG. 1;

FIG. 3 is a perspective view of one of the swaging members;

FIG. 4 is a perspective view of the support insert;

FIG. 5 is a perspective view of the rotary member;

FIG. 6 is a diagrammatic view of the position of the rollers within the rotary member;

FIG. 7 is a diagrammatic view showing the swaging members;

FIGS. 8*a*–8*d* show the various cross-sections of the juncture of the wire as it is being formed;

FIG. 9 is a side view of the apparatus of FIG. 1;

FIG. 10 is a partial perspective showing a formed portion of the wire; and

FIG. 11 is a perspective view showing a formed wire member in place as a wrapping post.

Referring now to FIG. 1, there is shown the apparatus generally designated as 10. It consists of a base portion 1, a flange portion 2 and a working head portion 5. Holes such as 3, 4 are provided around the periphery of portion 1 and are adapted to receive screws or bolts to secure them to a support member (not shown). Working head portion 5 has slots such as 6, 7, 8 and 9 therein. Slots 7 and 8 are colinear as are slots 6 and 9. Each rectangular slot has a smaller rectangular slot such as 11, 12 cut therein.

Adapted to reside in each slot are swaging members such as 13. They are identical and consist of a base portion 14, tapered portions 15 and a working end portion 16. The rear of each member is rounded, as at 18 and have projections 17 which are adapted to ride in the smaller slots, such as 11, 12, and guide the swaging members.

FIG. 2 shows working head 5 with four swaging members therein. Springs, such as 20, 20′ are used to bias each swaging member away from the center.

In the center of the working head is a bore 62 (FIG. 9) which contains a guide member 21. As seen in FIG. 4, member 21 has a pair of radial wing members 22 and 23 which have large tab portions 24 and 25, respectively.

Wing members 26 and 27, similar to members 22 and 23, are thinner and abut portions 28 and 30 of a wedging guide portion. Tab portions 29 and 31 are on portions 28 and 30, respectively. The members are grooved to provide a square aperture 32. The main portion of member 21 is first put into bore 62 and then the wedging guide portion is driven in to secure it therein.

FIG. 5 shows the pressure member 40 which has a pair of parallel plate members 41 and 42. Mounted between these plates are rollers 44–47 which project partially into an open area created by co-extensive apertures 43. Pins such as 48 secure the rollers for rotary movement and secure the plates in parallel position.

Working head 5 is adapted to project through the apertures and the rollers are adapted to act on the curved portion 18 of the swaging members 13.

FIG. 6 shows the relative positioning of the rollers. Angle X is greater than 90°.

FIG. 7 shows the working ends of the swaging member's bases 14 and 14′ having tapers 15 and 15′ and working ends 16 and 16′.

FIGS. 8*a*–8*d* show what happens to the cross-section of a square wire 50 as it is drawn through the device, with pauses for the swaging operations. The operation is three phase; upon rotation of member 40 one pair of swaging members act to produce areas 52 and 53 and section 51; further rotation of 40 causes the next pair of swaging members to move in until section 54 and area 55 is produced. At this point, member 40 is rotated in the opposite direction to its initial position. In doing this, the first pair of swaging members again act on wire 50 to produce section 56 and areas 57. This is possible due to the angle X in member 40 thus prohibiting all swaging members from acting at once.

FIG. 9 shows a side view of the apparatus with large aperture 60 in base 1 which then tapers as at 61 to bore 62.

FIG. 10 shows what the section 56 of FIG. 8*d* looks like in perspective. This is how the wire is sold or shipped. When one desires to make individual wrapping posts, they are merely snapped off by hand or by machine.

FIG. 11 shows a post 50 mounted in place in circuit board C with tapered portion 57 and end 50'.

Although the present invention has been described with reference to the particular embodiments therein set forth, it is understood that the present disclosure has been made largely by way of example and that numerous changes in the details of construction may be resorted to without departing from the spirit and scope of the invention.

What is claimed is:

1. An apparatus for producing a continuous length of wrapping post material having a series of equally spaced weakened portions therealong, said apparatus comprising a work holding means having an aperture for receiving a length of said material, a plurality of sets of swaging means slidably mounted to said holding means for forming said equally spaced weakened portions on said material, said swaging means are equally spaced about said aperture, a pressure means rotatably mounted to said holding means for sequentially operating said plurality of sets of swaging means to deform said material one set at a time, said pressure means includes a plurality of sets of camming means corresponding to said plurality of sets of swaging means wherein members of said sets of camming means are equally spaced about said aperture and said sets of camming means are unequally spaced relative to each other about said aperture to produce a sequential operation of said sets of swaging means.

2. An apparatus as in claim 1 wherein said work holding means has a pair of slots at 90° to each other, said plurality of sets of swaging means are two sets of swaging means, each set having two swaging means, each of said sets sliding in one of said slots.

3. An apparatus as in claim 2 wherein said camming means includes two sets of two pressure wheels, said sets are not at 90° relative to each other, said pressure wheels per set are at 180° relative to each other whereby sequential operation of one set of swaging means, then the remaining set of swaging means, and finally said one set of swaging means form said equally spaced weakened portions.

4. An apparatus as in claim 1 wherein said work holding means includes a plurality of slots therein intersecting said apertures for receiving said swaging means and a material guide member removably received in said aperture and having an orifice aligned with said aperture for receiving a length of said material.

5. An apparatus as in claim 4 wherein each of said slots has a channel therein, said guide member includes a plurality of extended members, each lying in a respective channel, thereby supporting said guide member, and means in each of said channels for biasing said swaging means outwardly.

6. An apparatus as in claim 5 wherein each of said swaging means includes a projection slidably received in said channels and said biasing means is between said projection of said swaging means and said extended member of said guide member.

* * * * *